United States Patent [19]

Ochiai et al.

[11] 4,447,166

[45] May 8, 1984

[54] PRINTING HEAD OF DOT PRINTER

[75] Inventors: Kuniaki Ochiai; Masami Horii; Takashi Norigoe, all of Shizuoka, Japan

[73] Assignee: Tokyo Electric Co., Ltd., Tokyo, Japan

[21] Appl. No.: 381,446

[22] Filed: May 24, 1982

[30] Foreign Application Priority Data

Jun. 4, 1981 [JP] Japan ..... 56-86141

[51] Int. Cl.[3] ..... B41J 3/12

[52] U.S. Cl. ..... 400/124; 101/93.05

[58] Field of Search ..... 400/124, 248; 101/93.05

[56] References Cited

U.S. PATENT DOCUMENTS 3,900,094 8/1975 Larsen et al. ..... 400/124
4,004,673 1/1977 Burzlaff et al. ..... 400/124
4,185,929 1/1980 Hebert ..... 101/93.05 X
4,211,496 7/1980 Naylor ..... 400/124

*Primary Examiner*—Paul T. Sewell
*Attorney, Agent, or Firm*—Oblon, Fisher, Spivak, McClelland & Maier

[57] ABSTRACT

In printing head of a dot printer according to this invention, a groove having width a little greater than diameter of top end of a needle is formed in front of a needle guide to guide the needle, position of top end of the needle is specified between the bottom of the groove and front surface of the needle guide, when the needle pushes through the printing head it returns rapidly, when top end of the needle is deformed it does not stick to the needle guide, a gauge spacer is interposed between the yoke and the guide holder to be assembled thereby position of top end of the needle is specified, and plural sheets of other spacer are overlaid and removed separately during grinding top end of the needle thereby the needle without deformation at top end can be formed and used for a long time.

6 Claims, 12 Drawing Figures

PRINTING HEAD OF DOT PRINTER

BACKGROUND THE INVENTION

1. Field of the Invention

This invention relates to dot printers, and more particularly to the structure of a printing head thereof.

2. Description of the Prior Art

FIGS. 1 and 2 show a first conventional example of support structure for needles in the top end of the printing head of a dot printer. Reference numeral 1 designates a guide holder. To the front surface of the guide holder 1 on the platen side is fixed a needle guide 3 which holds a plurality of needles 2 in a slightly projected state. During printing operations the needles 2 are driven by an electromagnet and strikes against a platen. However, the needles 2 are so thin that they may push through a printing ribbon 4. When the needles 2 are densely arranged, as is necessary for the printing of characters Chinese, the top ends of the needles 2 are as thin as 0.2–0.25 mm in diameter, and are accordingly liable to push through. Since the needles 2 project from the front surface of the needle guide 3 even during the non-excited states of their respective electromagnets, the printing ribbon 4 still catches on the needles 2 as shown in FIG. 2. The printing ribbon 4 may be moved to the side while a needle is so caught. Therefore, the needles 2 can be subjected to side pressure, resulting in the bending or breaking of the needles 2.

In a second example shown in FIGS. 3 and 4, the front end of the needles 2 and the front surface of the needle guide 3 coincide. In this arrangement when a needle 2 is fully retracted, it would seem that the printing ribbon 4 is separated from the needle 2. However, a certain time is requred for the needle 2 to return completely (corresponding to T in FIGS. 9 amd 10), and the needle 2 before returning is subjected to side pressure from the ribbon 4 being moved to the side. Therefore, the danger of bending or breaking a needle 2 is not eliminated. Moreover, in the arrangement as shown in FIG. 3, if the top end of a neelde 2 is even slightly thickened by striking against a platen, the needle 2 sticks to its support hole 5 in the needle guide 3 and cannot slide. In this situation, abrasion in the armature of the corresponding electromagnet and on the rear end of the needle 2 also becomes serious.

In a third example as shown in FIG. 5, a recess 6 is formed in the front of the needle guide 3 by means of cutting work, and the needles 2 project from the bottom of the recess 6. In this arrangement, even if the top end of a needle 2 becomes thick because of striking against a platen, the needle 2 does not stick to the support hole 5 of the needle guide 3. However, if the needle 2 pushes through a printing ribbon 4, the printing ribbon 4 can catch on the needle 2 during restoring and be drawn into the bottom of the broad recess 6. If this happens, phenomena similar to the case shown in FIGS. 1 and 2 occur. Individual needles 2 differ from each other in frequency of striking against the platen. Therefore, unevenness of the top end of the needle 2 occurs. In the arrangement shown in FIG. 3 and FIG. 5, the top end of the needle 2 cannot be ground in order to correct the above mentioned unevenness. Because the front surface of the needle guide 3 and the top end surface of the needles 2 coincide, an artificial ruby or sapphire is used in the needle guide 3 for improving abrasion resistance.

PURPOSE OF THE INVENTION

An object of this invention is to provide a printing head in which the needles return rapidly when they push through a printing ribbon.

Another object of this invention is to provide a printing head in which the needles do not stick to the needle guide when the top end of a needle is deformed.

Another object of this invention is to provide a printing head in which the top end positions of the needles are determined accurately.

Another object of this invention is to provide a printing head in which the pitch of the dot printed by each needle is fine.

Another object of this invention is to provide a printing head in which the top end of the needles are ground, and the needles can be used for a long time.

DETAILED DESCRIPTION OF THE INVENTION

Figure 5:
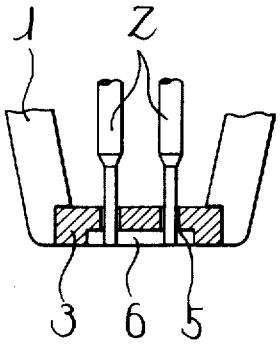
Fig. 5 PRIOR ART
FIG. 5 is a horizontal sectional view of a third example in the prior art illustrating support for needles.
Figure 6:
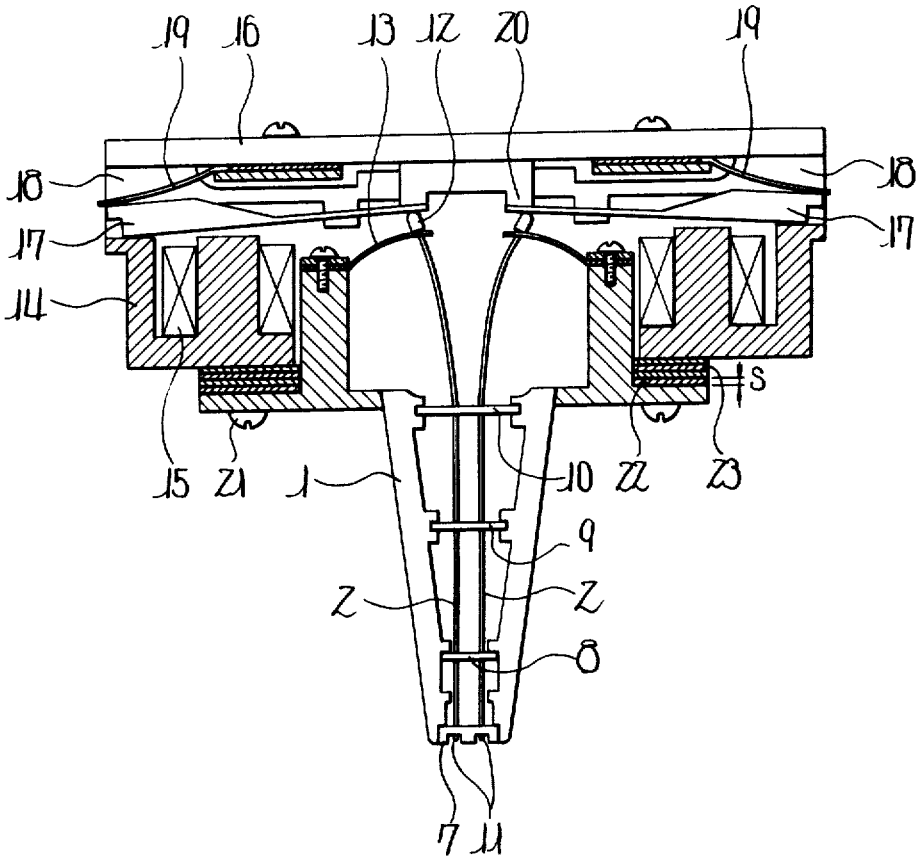
FIG. 6 is a horizontal sectional view of an embodiment of this invention.
Figure 7:
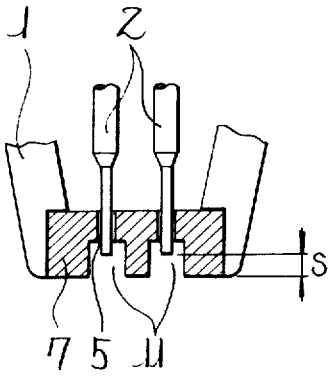
FIG. 7 is an enlarged horizontal sectional view illustrating support structure of the top ends of needles of an embodiment of this invention.
Figure 8:
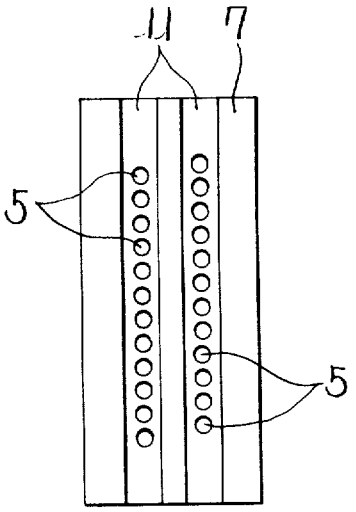
FIG. 8 is an enlarged front view of a needle guide of an embodiment of this invention.

An embodiment of this invention will now be described referring to FIGS. 6 in 10. Like parts to FIGS. 1 to 5 are described by like reference numerals. A guide holder 1 is provided with needle guides 7, 8, 9, 10 which hold a plurality of needles 2 slidably. The needle guide 7 is opposed to a platen and is made of aluminium oxide (sintered alloy). Two grooves 11 and support holes 5 are formed in the top end of the needle guide 7 during formation of the needle guide 7. Therefore, the structure of the needle guide 7 is simple, and manufacturing of the needle guide 7 is easy because secondary machining is unnecessary. The grooves 11 are formed in two narrow parallel lines perpendicular to longitudinal direction of the platen, and the width of each groove 11 is a little greater than the diameter of the top ends of the needles 2. The support holes 5 are formed in the bottom of each groove 11. The support holes 5 in the first and second grooves 11 are shifted by about half a pitch so that printed characters are clear. To the guide holder 1 are fixed needle springs 13 which are engaged with caps 12 fixed to the rear end of the needle 2. The needle springs 13 urge the needle 2 rearwards.

Electromagnets 15 are radially arranged on yokes 14, and a cover 16 is screwed thereto. Armatures 17 of the electromagnets 15 are movably supported by armature guides 18 on the yokes 14. The armatures 17 are urged in the restoring direction by means of leaf armature springs 19 installed on the cover 16 and stopped in position by a stopper 20 supported by the armature guides 18. The guide holder 1 and the yokes 14 are connected using screws 21, and during assembling work a gauge spacer 22 of thickness s and plural spacers 23 of thickness s' are grapsed therebetween. In this state the top ends of the needles 2 projects from the bottoms of the grooves 11 and stands back from the front surface of the needle guide 7 by the dimension s. The dimension s coincides with the thickness of the gauge spacer 22. However, stroke S is greater than this.

Figure 1:
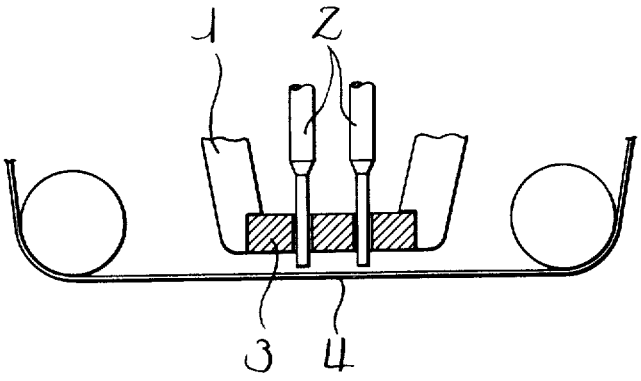
Fig. 1 PRIOR ART
FIG. 1 is a horizontal sectional view of a first example in the prior art illustrating support structure for needles.
Figure 2:
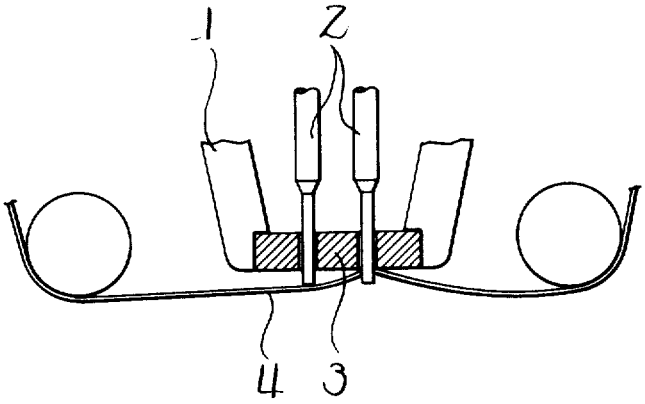
Fig. 2 PRIOR ART
FIG. 2 is a horizontal sectional view illustrating a needle sticking to a ribbon.
Figure 3:
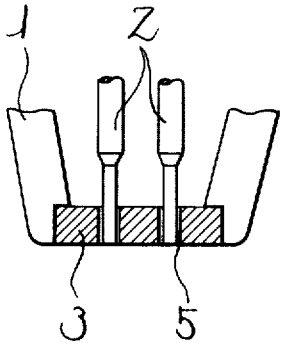
Fig. 3 PRIOR ART
FIG. 3 is a horizontal sectional view of a second example in the prior art illustrating support structure for needles.
Figure 4:
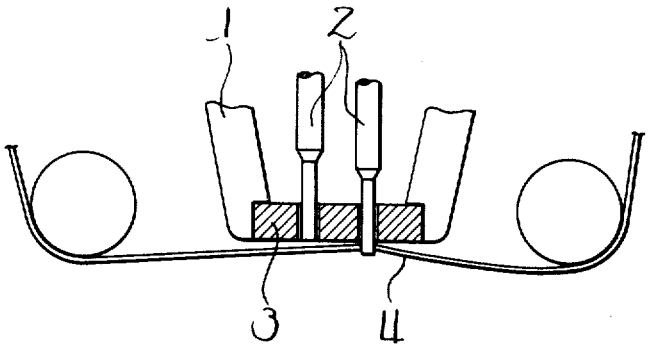
Fig. 4 PRIOR ART
FIG. 4 is a horiziontal sectional view illustrating a needle sticking to a ribbon.
Figure 9:
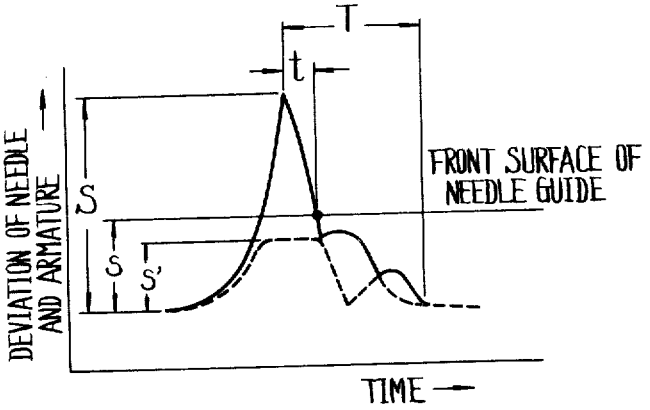
FIG. 9 is a graph illustrating the action of the armature and the needle in a flying system, showing the relation of time and deviation.

If an electromagnet 15 is excited in this arrangement, the associated armature 17 pushes the cap 12 of the associated needle 2. The needle 2 then strikes against the platen, and printing is thereby performed. Printing systems include flying systems, in which the needles 2 are struck by the armature 17 and allowed to transfer their inertia to the needles 2, and pressure systems in which the armatures 17 push the needles against the platen. The action in flying systems will be described referring to FIG. 9. The armature 17 is excited for a given time to act with stroke s' as shown in dotted line, and then restored by means of the force of the armature spring 19. During the restoring action, the armature 17 is contacted with the stopper 20 and bounces but is immediately settled to its supported state by the stopper 20. The needle 2 struck by the armature 17 strikes against the platen by inertia with stroke S as shown in solid line and is the restored. During restoring action, the needle 2 strikes the armature 17 and bounces, then strikes the armature 17 again each time being repulsed by striking against the stopper 20. After repeating this action, the needle 2 is settled in its restoring position. T is the time from striking of the needle 2 against the platen until completion of restoring. In the examples of the prior art as shown in FIGS. 1, 3 and 5, the printing ribbon 4 and the needle 2 continue to be in contact with each other for the time T. According to this invention, the printing ribbon 4 is supported by the front surface of the needle guide 7. Even if the needle 2 pushes through the printing ribbon 4 and both are contacted, connection is effected for time t and at distance S−s. Time t is much smaller than time T, and the feed amount of the printing ribbon 4 during time t is quite small. Accordingly, the tension on the printing ribbon 4 does not attain sufficient strength to bend or break the needle 2. After lapse of time t, the printing ribbon 4 is supported by the front surface of the needle guide 7 and the needle 2 returns by itself. Even if the needle 2 pushes through the printing ribbon 4, it is pulled free in the latter half of the restoring action, and there is no fear of bending or breaking of the needle 2 or obstruction preventing restoring.

Figure 10:
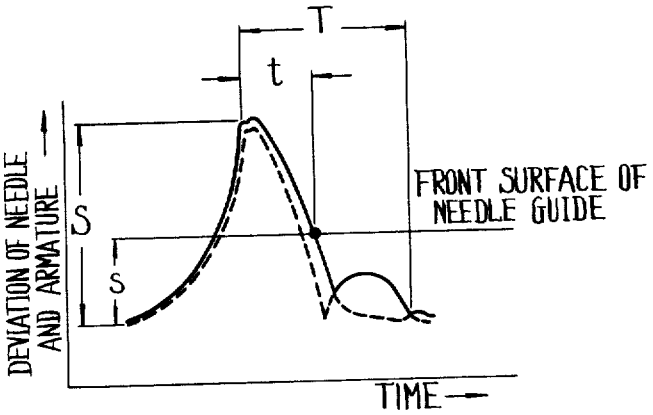
FIG. 10 is a graph illustrating the action of the armature and the needle in a pressure system, showing the relation of time and deviation.

Action in pressure system will be described referring to FIG. 10. If the electromagnet 15 is excited, the armature 17 acts as shown in dotted line and is restored. During restoring action, the armature 17 strikes against the stopper 20 and bounces but is settled immediately. The needle 2 strikes against the platen and is restored a little later than the armature 17, and then is contacted with the armature 17 bouncing by repulsion of the stopper 20 and bounces but is settled immediately. In this system also, the printing ribbon is supported by the front surface of the needle guide 7, and the printing ribbon is contacted with the needle 2 for a short time t and at distance S−s. Accordingly, a function similar to the flying system can be obtained. A larger effect may be obtained by deepening the grooves 11, which enlarges the distance s. If s is made smaller than the stroke s' of the armature 17 in the flying system, a more or less similar effect is obtained.

The diameter of the top ends of the needles 2 gradually increase as the result of striking against the platen. However, since the restoring position is specified as a position at which the top ends of the needles 2 project from the bottom of the grooves 11 and the width of the grooves 11 has tolerance for inserting the needles 2 freely, the needles 2 do not stick to the support holes 5 of the needle guide 3. However, individual needles 2 differ in the amount by which the diameter of the top end increases and in abrasion state, and therefore the needles 2 must be ground at regular intervals. During grinding, the gauge spacer 22 and one sheet of the spacer 23 are removed, the yoke 14 and the guide holder 1 are tightened again, and the needle 2 is projected from the front surface of the needle guide 7 with a stroke equal to depth of (s+1) sheets of the spacer 23. In this state, the top end surface of the needle 2 is ground until it coincides with front surface of the needle guide 7. Even if the grinder contacts the front surface of the guide 7, the needle guide 7 is too hard to be ground away. Accordingly, the dimension to be ground is easily specified. After the grinding work, the removed one sheet of the spacer 23 is thrown away, and the gauge spacer 22 is assembled together with the other spacers 23, thereby returning the top end of the needle 2 to its correct restoring position. There are plural sheets of the spacer 23. Therefore, grinding can be effected a number of times corresponding to the number of sheets. As above described, the top ends of the needles 2 are ground without the grinding of the needle guide 7, and the relative position of the needle guide 7 and the top end of the needles 2 with respect to the platen can be held constant.

Figure 11:
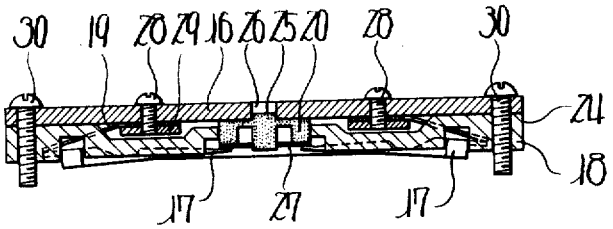
FIG. 11 is a horizontal sectional view of a modification of this invention.
Figure 12:
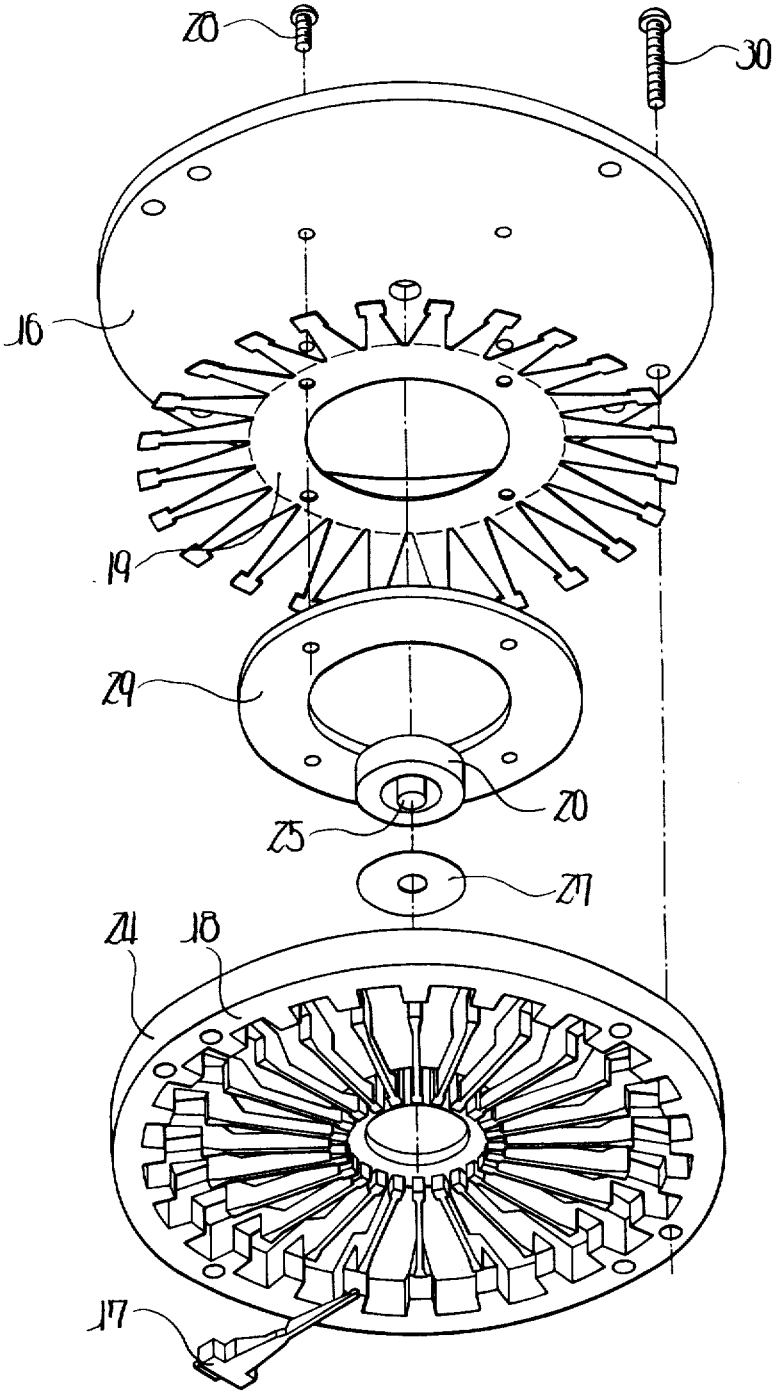
FIG. 12 is an exploded perspective view of the modification.

A modification of this invention will be described referring in FIGS. 11 and 12. Like parts to the first embodiment are designated by like reference numerals, and a detailed description is omitted except for the following point of difference. An outer circumference 24 of an armature guide 18 is formed as part of a cylindrical surface and simplified without internal parts. A shaft portion 25 is formed at the center of a stopper 20 and fitted to a hole 26 formed at the center of a cover 16. Accordingly, the position of the shaft portion 25 is specified. Mylar (trade-name) film 27 is interposed between the stopper 20 and an armature 17 so as to prevent deformation of the stopper 20. An armature spring 19 is grasped by a spring pushing member 29 of ring form fixed by a screw 28. The cover 16, the armature guide 18 and a yoke 14 are integrally constituted using screws 30.

We claim:

1. A printing head for a dot printer, said printing head comprising:

(a) a cover;

(b) a guide holder mounted on said cover;

(c) a needle guide surface on said guide holder, said needle guide surface having:

(i) a groove formed therein the width of which is a little greater than the diameter of the working ends of the needles and (ii) a plurality of needle support holes formed in the bottom of said groove and having a diameter which is a little greater than the corresponding needle diameter;

(d) a plurality of needles disposed in said guide holder and slidably projecting through said holes, each of said needles normally being disposed in a first position in which it projects through one of said holes by a first amount which is less than the depth of said groove;

(e) electromagnetic means for driving said plurality of needles from said first position to a second position in which they project through said holes by a second amount which is greater than the depth of said groove;

(f) mechanical means for returning said plurality of needles from said second position to said first position after each actuation thereof; and (g) spacer means disposed between said cover and said guide holder, said spacer means including:

(i) a removable gauge spacer the thickness s of which is less than the stroke of said needles and (ii) a plurality of removable spacer shims of thickness s', said removable gauge spacer and said removable spacer shims being disposed between said cover and said guide holder such that, when said removable gauge spacer and said removable shims are in position and said needles are in their first position, the working ends of said needles are beneath said needle guide surface by the distance s, which distance is sufficient so that said needles will disengage completely from a printing ribbon passing over said needle guide surface; in the absence of said removable gauge spacer, the working ends of said needles are coincident with said needle guide surface; and, when said removable gauge spacer and one of said plurality of removable spacer shims is removed, the working ends of said needles protrude beyond said needle guide surface by the distance s', which distance is sufficient so that working ends of said needles which have been thickened by repeated use can be ground off and said needles ground down until their working ends are once more coincident with said needle guide surface, after which said removable spacer guide can be replaced, restoring the printing head to its operative condition.

2. A printing head as recited in claim 1 wherein:

(a) two parallel spaced grooves are formed in said needle guide surface;

(b) a plurality of needle support holes are formed in the bottom of each of said grooves; and (c) a needle slidably projects through each of said needle support holes in each of said grooves.

3. A printing head as recited in claim 2 wherein said needle support holes in each of said grooves are spaced from said needle support holes in the other of said grooves by half a pitch.

4. A printing head for a dot printer, said printing head comprising:

(a) a cover;

(b) a guide holder mounted on said cover;

(c) a needle guide surface on said guide holder, said needle guide surface having:

(i) a groove formed therein the width of which is a little greater than the diameter of the working ends of the needles and (ii) a plurality of needle support holes formed in the bottom of said groove and having a diameter which is a little greater than the corresponding needle diameter;

(d) a plurality of needles disposed in said guide holder and slidably projecting through said holes, each of said needles normally being disposed in a first position in which it projects through one of said holes by a first amount which is less than the depth of said groove;

(e) electromagnetic means for driving said plurality of needles from said first position to a second position in which they project through said holes by a second amount which is greaer than the depth of said groove;

(f) mechanical means for returning said plurality of needles from said second position to said first position after each actuation thereof; and (g) spacer means disposed between said cover and said guide holder, said spacer means including a removable gauge spacer the thickness s of which is less than the stroke of said needles, said removable gauge spacer being disposed between said cover and said guide holder such that, when said removable gauge spacer is in position and said needles are in their first position, the working ends of said needles are beneath said needle guide surface by a distance greater than or equal to the distance s, which distance is sufficient so that said needles will disengage completely from a printing ribbon passing over said needle guide surface, and, in the absence of said removable gauge spacer, the working ends of said needles are coincident with or beneath said needle guide surface.

5. A printing head as recited in claim 4 wherein:

(a) two parallel spaced grooves are formed in said needle guide surface;

(b) a plurality of needle support holes are formed in the bottom of each of said grooves; and (c) a needle slidably projects through each of said needle support holes in each of said grooves.

6. A printing head as recited in claim 5 wherein said needle support holes in each of said grooves are spaced from said needle support holes in the other of said grooves by half a pitch.

* * * * *